US007726221B2

(12) United States Patent
Tweg

(10) Patent No.: US 7,726,221 B2
(45) Date of Patent: Jun. 1, 2010

(54) FOOD DICER

(76) Inventor: Edward Tweg, 51 Herzel Street, Ramle (IL) 72406

( * ) Notice: Subject to any disclaimer, the term of this patent is extended or adjusted under 35 U.S.C. 154(b) by 208 days.

(21) Appl. No.: 11/921,412

(22) PCT Filed: Jun. 6, 2006

(86) PCT No.: PCT/IL2006/000652

§ 371 (c)(1),
(2), (4) Date: Nov. 30, 2007

(87) PCT Pub. No.: WO2006/131911

PCT Pub. Date: Dec. 14, 2006

(65) Prior Publication Data

US 2009/0123623 A1 May 14, 2009

(51) Int. Cl.
*B26D 3/18* (2006.01)

(52) U.S. Cl. ..... 83/36; 83/857; 83/932

(58) Field of Classification Search ..... 83/35, 83/36, 857, 858, 932, 404.2
See application file for complete search history.

(56) References Cited

U.S. PATENT DOCUMENTS

| | | | | |
|---|---|---|---|---|
| 1,430,289 | A | 9/1922 | Dahmer | |
| 2,242,932 | A * | 5/1941 | Turner et al. | 83/878 |
| 4,441,254 | A | 4/1984 | Borner | |
| 6,732,622 | B2 | 11/2003 | Vincent | |
| 2005/0061124 | A1 * | 3/2005 | Vincent | 83/247 |
| 2006/0081108 | A1 * | 4/2006 | de Buyer | 83/703 |
| 2007/0089577 | A1 * | 4/2007 | Wong | 83/13 |

FOREIGN PATENT DOCUMENTS

| | | |
|---|---|---|
| DE | 3500959 | 7/1986 |
| DE | 3642704 | 6/1988 |
| GB | 264 427 | 1/1927 |
| GB | 2 032 260 | 5/1980 |
| WO | WO 2005/097434 | 10/2005 |

* cited by examiner

*Primary Examiner*—Kenneth E. Peterson
(74) *Attorney, Agent, or Firm*—Robert G. Lev

(57) ABSTRACT

A dicing tool having: a foodstuff holder for holding a block of foodstuff and a cutting base; the cutting base having: a rectangular framework for sliding the foodstuff holder thereal-ong; a first part having an triangular shaped front edge, equally spaced triangular cutting blades being arranged in a triangular arrangement that follows the profile of the triangularly shaped front edge; a handle; a second part having a second upper surface and a right front edge and a left front edge arranged in a deep V shape, with continuous blades attached to the right and left front edges; wherein the second upper surface is always parallel to the first surface and can be slidingly reciprocated between an upper position and a lower position where the horizontal blade is substantially on a level with the first surface and the base of the triangular cutting blades.

2 Claims, 5 Drawing Sheets

FOOD DICER

FIELD OF THE INVENTION

The present invention is directed to providing a device for dicing food, and a convenient method for food dicing.

BACKGROUND

Frequently, there is a desire to chop fruit, vegetables, cheeses, breads, meats and other foodstuffs into cubes or dice. For small quantities, an appropriate knife may be used. The foodstuff is first sliced in one direction. Then the slices are themselves sliced in a second direction, perpendicular thereto, providing chips. Finally, the chips are cut into cubes. The slices and chips may be further sliced or cut individually. For speed and convenient, the sliced foodstuff is turned through ninety degrees to form a stack of slices that is then sliced through in two mutually perpendicular directions.

Knives make one cut at a time, and manually dicing is time consuming, labor intensive and risks cutting fingers, particularly where occasional cooks attempt to dice foodstuffs. Additionally any technique that relies on making one cut at a time, relying on the eye of the knife wielder to ensure that the foodstuff is cut into equal lengths, will invariable result in uneven lengths. With one dimensional objects, this is not necessarily too bad, but where the foodstuff is to be diced into cubes, miscalculation of length leads to an unaesthetic result.

There have been several attempts to mechanize the slicing, chipping and dicing processes. For example, the egg slicer has a concave receptacle for receiving an egg, and an array of wires that can be drawn down at once, thereby slicing the egg into slices. Since the wires are equally spaced, the egg is sliced into slices of the same thickness, and the egg slicer is valuable when making large quantities of egg sandwiches. Although wires can be used for cutting cheese as well, an array of wires is really only useful for slicing eggs, soft cheeses, bananas and other foodstuffs of similar low resistance. It cannot be used on firmer vegetables, such as potatoes, and cannot be used on soft-fruit or vegetables, such as tomatoes, for example.

A grid of criss-crossing knife blades has been used as the cutting means of potato chipping devices, where the potato is forced through the grid and is cut into chips thereby. Such a device is useful for chipping.

Although a further guillotine blade could be added in front of the grid, at a fixed distance therefrom, to cut the extruded chips into cubes, such a guillotine blade would only make one cut at a time, and would be inherently dangerous. Furthermore, the extrusion through grid of blades is good for materials that can be forced through without suffering damage in consequence, such as potatoes, for example. Such a device would not be suitable for fresh summer fruits or for making an Israeli style, tomato and cucumber salad for example.

At the same time, there are also numerous electric vegetable slicers or food processors for household use or designed for use in industry. These are multi-purpose machines and are generally-sophisticated appliances which, apart from their high cost, often have the disadvantage of being inconvenient to use and also difficult to assemble and clean.

United Kingdom Patent No. GB 2 032 260 to Leung Chi Shih describes a vegetable slicer comprising a holder, a table on which the holder may be slid back and forth, a horizontal knife blade at a distance above the table, such that sliding the holder back and forth causes vegetables and other foods within the holder to be sliced by the knife blade. A series of upright knives can be caused to protrude above the table top, which together with the horizontal blade, cuts the food into chips.

German Patent Number DE3642704A1 to Haushaltsprodukte Vertriebsges describes a food cube cutting appliance—having a cutting board and food holder with engaging guide grooves or rails.

The device described serves for cutting foodstuffs into pieces, preferably for dicing onions. It is composed of a cutting board having a plurality of vertical knives which are arranged on the cutting board and project upwards from the grating surface of the latter, and of a horizontal knife which is arranged at a predetermined distance above and parallel to the grating surface of the cutting board. On the longitudinal sides of the cutting board there are provided guiding grooves, into which engage the guiding webs of a holding device, which contains a cylindrical supporting body which is open on its underside and a cylindrical insert which is arranged inside the said supporting body, accommodates the foodstuff and can be rotated with respect to the supporting body. The said insert has toes which are arranged at regular intervals around its circumference on its underside and engage in baffles which are provided on the grating surface, so that the rotatable insert is rotated through a predetermined number of degrees. The food is slid back and forth tangentially with respect to the horizontal cutting blade. By rotating the food, the orientation of the food with the plurality of vertical cutting blades is varied. Since the food to be cut impacts the horizontal cutting blade head on, even where the blade is sharp, such a system, though no doubt ideal for cubing onions, the intended purpose thereof, is unable to slice ripe tomatoes without squashing them.

U.S. Pat. No. 6,732,622 to Vincent Jacques, titled "Safety manual vegetable cutter" relates to a manual vegetable cutter for selectively varied cutting, that comprises a frame fitted with at least one cutting blade mounted transversely facing a slot through which the cut vegetables pass and also two side rails providing guidance in to and fro translational motion for a guide chamber equipped with a loading volume for the vegetables to be cut up and acting in conjunction with a press-down cap which the user grips in order to move the guide chamber to and fro along the guide rails while constantly exerting pressure on the vegetables contained in the loading volume so that they are pressed against the cutting blade or blades fitted to the frame and can be cut up by the blade or blades. This device appears to slice, but not to dice foodstuffs.

PCT Application Number WO 2005/097434 to Klotzz and Scramm describes a device for comminuting foodstuffs. As shown in FIGS. 8 and 9 thereof, the blade thereof is a V shaped cutting blade. This type of blade slices both sides of a tomato or the like that is forced thereagainst, with the blade being held at a sharp angle to the side of the tomato. Usefully, the blade can be lowered to the height of, or below the height of the slit, thereby protecting it between use and also keeping it effectively sheathed and away from fingers.

United Kingdom Patent Number 264,427 to Herzmann describes yet another machine for cutting fruit or vegetables into cubes, strips or slices.

German Patent Number DE 3500959 describes a vegetable cutter with an adjustable cutting thickness that has an elongate basic body, having a handle at one end, and a slide path which is formed by a pushing-on surface, a blade and a pushing-off surface. The pushing-on surface is clamped to the basic body on one side in the region of the handle and is adjustable in its inclination by means of a displaceable wedge device. As a result, an adjustable gap is produced between the free end of the pushing-on surface and the blade. The wedge device is formed by a slide which is displaceable below the pushing-on surface towards the free end thereof and engages on a wedge surface (wedge rib) which acts in the longitudinal direction between the pushing-on surface and the slide. The device described does not appear to be able to chip or cube vegetables, merely to slice them.

U.S. Pat. No. 4,441,254 to Borner describes a kitchen utensil for cutting foodstuffs such as vegetables or fruit into strips and particularly to a blade member therefor, the blade member comprising a strip of material such as metal which is integral with a plurality of spaced substantially vertical cutting blades which project from the plane of the strip, the strip being embedded in a guide plate, over which the foodstuff is moved during cutting, so that the blade member is securely held, the vertical blades projecting above the guide plate. The strip has cuts in one longitudinal edge and the metal between the cuts is bent up to form the vertical blades. The blade member described by Borner is one directional and allows cutting by pushing or pulling, but not by both.

Despite the many tools and techniques described in the prior art and commercially available, there is a need for a foodstuff dicer that can cut soft fruit and vegetables into cubes, the blades thereof cutting in both directions and the opposite faces of the cube being perfectly parallel. The present invention addresses this need.

SUMMARY OF THE INVENTION

It is an aim of the invention to provide a manual tool for the convenient dicing of vegetables and other foodstuffs.

It is a further aim of the invention that the manual tool does not require any electrical power and cannot cause electrocution.

Furthermore, by being manual, the tool is relatively cheap to manufacture.

The device has a minimum number of parts and is easy to clean, and keep hygienic.

In accordance with a first embodiment, the present invention is directed to providing a dicing tool comprising: a foodstuff holder for holding a block of foodstuff and a cutting base; the cutting base comprising: a rectangular framework with sides for sliding the foodstuff holder therealong; a first part having an triangular shaped front edge and a first upper surface on which a plurality of equally spaced triangular cutting blades are fixed to protrude perpendicularly therefrom; the equally spaced triangular cutting blades being arranged in a triangular arrangement that follows the profile of the triangularly shaped front edge; a handle coupled rigidly to the first part, at short end thereof, opposite to the triangular edge; a second part having a second flat surface and a right front edge and a left front edge arranged in a deep V shape, with continuous blades attached to the right and left front edges; such that the second surface is parallel to the first surface and can be slidingly reciprocated between an upper position where the horizontal blade is substantially on a level with the apices of the triangular cutting blades, and a lower position where the horizontal blade is substantially on a level with the first surface and the base of the triangular cutting blades.

Typically, the foodstuff holder comprises: a lower section that has a flange around its mouth and an engaging means for engaging the long sides of the cutting base, so that it can be slid along the cutting base from one side to another; an upper section that resembles an inverted cup with a hole through its base and a needle arrangement attached to inside of the base for engaging the block of foodstuff; a plunger that protrudes over the inverted cup that is connected via a connecting rod that passes through the hole in the base of the inverted cup to a perforated plate that slides over the needle array, such that depression of cup forces the perforated plate down needle array and pushes any foodstuff impaled upon needle array, off needles and downwards through the opening of the inverted cup and flange towards the cutting base therebeneath.

In one embodiment, the second upper surface of the cutting base of the dicing tool has a clasp attached thereto such that said clasp is positioned behind and beneath the handle of the cutting base and coupled thereto with a Hookian member; such that squeezing the clasp towards the handle brings the second section down towards the first section, and brings the V shaped horizontal cutting blade into alignment with the triangular shaped front edge of the first section, thereby resulting in the second section assuming its lower position; and releasing the clasp releases the potential energy stored in the Hookian member, causing Hookian member to expand and bring the second section to its upper position.

In a second aspect, the present invention is directed to a method of dicing a foodstuff with the dicing tool described above, comprising the steps of: (i) bringing the second part into its lower position by bringing the clasp into proximity with the handle; (ii) sliding the foodstuff holder along the cutting base and over the upper surface of the first and second parts from the second part onto the first part, across the triangular vertical blades towards the handle, making a first plurality of regularly spaced, equidistant vertical cuts in the block of foodstuff thereby; (iii) releasing the clasp and allowing the second part to assume its upper position with the V shaped horizontal blade aligned with the apices of the triangular vertical blades under urging of the Hookian member; rotating the foodstuff holder through 90°, thereby rotating the block of foodstuff with respect to the triangular vertical blades, and drawing the block of foodstuff across the triangular vertical blades; making a second plurality of regularly spaced, equidistant vertical cuts tangential to the first plurality of regularly spaced, equidistant vertical cuts, and across the V shaped horizontal blade, thereby slicing across the base of the block of foodstuff, severing dices of foodstuff therefrom.

In a second embodiment, the cutting base has a pair of levers attached to opposite ends thereof; such that sliding the foodstuff holder in one direction along the cutting base, trips a first lever and brings the second part down towards the first part, bringing the V shaped horizontal cutting blade into alignment with the triangular shaped front edge of the first part, the second part assuming its lower position thereby; whereas sliding the foodstuff holder in the opposite direction along the cutting base trips a second lever and brings the second part up away from the first part and brings the V shaped horizontal cutting blade into alignment with the apices of the triangular vertical cutting blades, the second part assuming its upper position thereby.

In a second aspect, the present invention is directed to a method of dicing a foodstuff with the dicing tool of the second embodiment, comprising the steps of:

(i) Bringing the second part into its lower position by impacting the first lever with the foodstuff holder; (ii) Sliding the foodstuff holder along the cutting base and over the upper surface of the first and second parts from the second part onto the first part, across the triangular vertical blades towards the handle thereby making a first plurality of regularly spaced, equidistant vertical cuts in the block of foodstuff; (iii) Impacting the second lever with the foodstuff holder thereby causing the second part to assume its upper position, thereby aligning the V shaped horizontal blade with the apices of the triangular vertical blades; (iv) Rotating the foodstuff holder through 90°, thereby rotating the block of foodstuff with respect to the triangular vertical blades; (v) Drawing the block of foodstuff back over the cutting base, across the triangular vertical blades making a second plurality of regularly spaced, equidistant vertical cuts tangential to the first plurality of regularly spaced, equidistant vertical cuts, and across the V shaped horizontal blade, thereby slicing across the base of the block of foodstuff, severing cubes of foodstuff therefrom.

In a third embodiment, the flange of the foodstuff holder has a cut away section on one side thereof, and further comprises a wheel mounted near one end of a spring loaded lever fastened by an axle to the food stuff holder, such that pulling the lever brings the wheel down below the flange and passes the second section down towards the first section and brings the V shaped horizontal cutting blade into alignment with the triangular shaped front edge of the first section, the second section assuming its lower position thereby; and releasing the spring loaded lever causes the wheel to retract, bringing the second section up away from the first section and bringing the V shaped horizontal cutting blade into alignment with the apices of the triangular vertical cutting blades, the second section assuming its upper position thereby.

The third embodiment may be used to dice a foodstuff with the dicing tool by the method comprising the steps of: (i) Pulling the lever, thereby bringing the wheel below the flange of the foodstuff holder and bringing the second section into its lower position; (ii) Sliding the foodstuff holder along the cutting base and over the upper surface of the first and second sections from the second section onto the first section, across the triangular vertical blades towards the handle, making a first plurality of regularly spaced, equidistant vertical cuts in the block of foodstuff thereby; (iii)) Releasing the lever, thereby bringing the wheel below the flange of the foodstuff holder and bringing the second section up away from the first section thereby bringing the V shaped horizontal cutting blade into alignment with the apices of the triangular vertical cutting blades, the second section assuming its upper position thereby, and (iv) Drawing the block of foodstuff back over the cutting base, across the triangular vertical blades making a second plurality of regularly spaced, equidistant vertical cuts tangential to the first plurality of regularly spaced, equidistant vertical cuts, and across the V shaped horizontal blade, thereby slicing across the base of the block of foodstuff, severing dices of foodstuff therefrom.

In a further aspect, the present invention is directed to a method of fabricating triangular vertical blades of the cutting tool, comprising the steps of: (i) sharpening one edge each of two lengths of steel strip; (ii) Stamping out superfluous material from one length, leaving front halves of triangular teeth, and folding front half teeth through 90° with respect to the second strip; (iii) Stamping out superfluous material from second length leaving back halves of triangular teeth; (iv) Folding back half teeth through 90° with respect to the second strip, and (v) Spot welding the two strips together thereby giving a single strip of triangular blades sharpened on both sides.

Optionally the triangular blades are attached to the first part of the horizontal cutting base by poked the triangular blades through corresponding slots in the first part of the horizontal cutting base.

Alternatively, the triangular blades are attached to the first part of the horizontal cutting base by injection moulding the first part of the horizontal cutting base therearound.

In accordance with a further embodiment, the present invention is directed to providing a dicing tool comprising: a foodstuff holder for holding a block of foodstuff and a cutting base; the cutting base comprising: a rectangular framework with tracks along both sides thereof for sliding the foodstuff holder therealong; a first part having a slanted front edge and a first upper surface on which a plurality of equally spaced triangular cutting blades are fixed to protrude perpendicularly therefrom; the equally spaced triangular cutting blades being arranged in a slanted arrangement that follows the profile of the slanted front edge; a handle coupled rigidly to the first part, at short end thereof, opposite to the slanted edge; a second part having a slanted blade attached to the front edge thereof; such that the second surface is parallel to the first surface and can be slidingly reciprocated between an upper position where the horizontal blade is substantially on a level with the apices of the triangular cutting blades, and a lower position where the horizontal blade is substantially on a level with the first surface and the base of the triangular cutting blades.

The dicing tool may be used for dicing a block of foodstuff selected from the list of a piece of fruit, a vegetable, a block of cheese, tofu, soya curd, salami, minced meat and bread.

BRIEF DESCRIPTION OF THE FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DESCRIPTION OF THE PREFERRED EMBODIMENTS

The present invention is a dicing tool that enables the dicing of foodstuffs, such as vegetables, into cubes.

Figure 1:
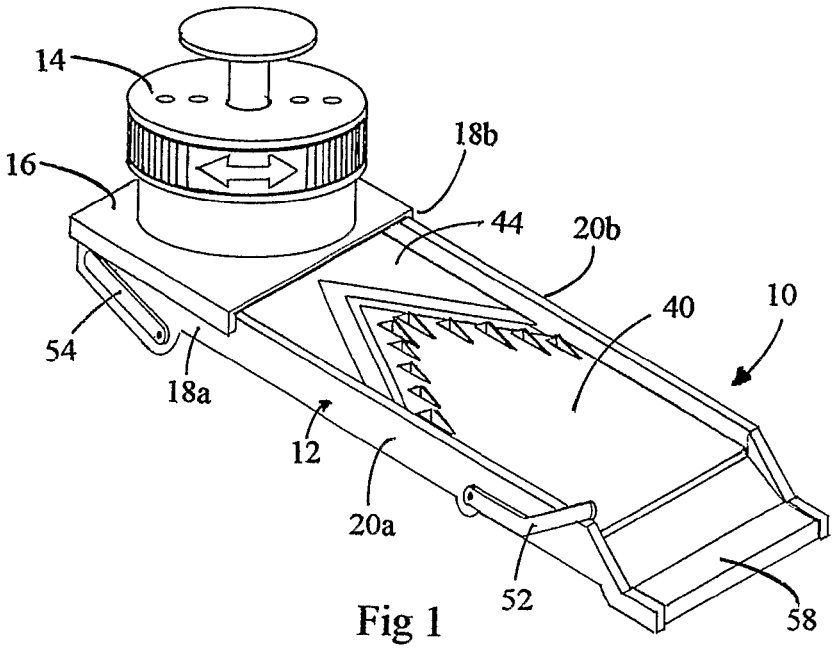
FIG. 1 is a schematic isometric projection of one embodiment of a food dicer in accordance with one embodiment of the present invention wherein the to and fro sliding of the foodstuff holder raises and lowers the horizontal cutting blade.

With reference now to FIG. 1, a dicing tool 10 is shown. Dicing tool consists of two main parts: a cutting base 12, and a foodstuff holder 14 for holding a block of foodstuff. The foodstuff holder 14 slides along the cutting base 12, either on tracks therealong, or, as shown, the mouth (FIG. 2*b*) 28 of the foodstuff holder 14 may have a square flange 16 therearound, with edges 18*a*, 18*b* that overlap sides 20*a*, 20*b* of the cutting base 12.

Figure 2A:
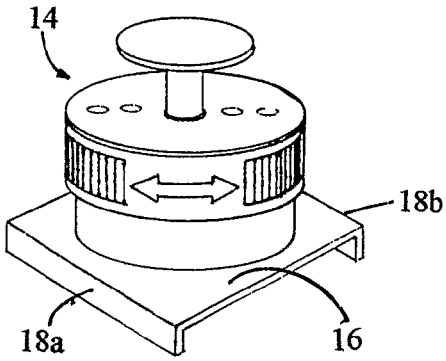
FIG. 2*a* is an isometric projection of a foodstuff holder according to one embodiment thereof.
Figure 2B:
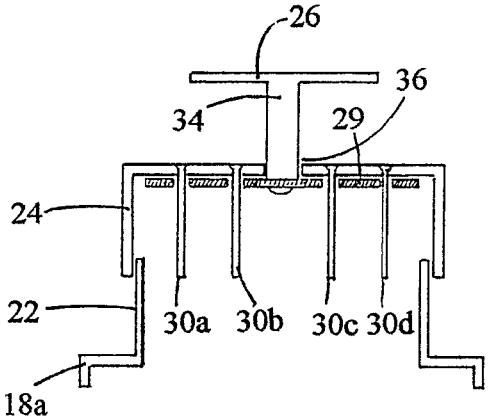
FIG. 2*b* is a cross section through the foodstuff holder of FIG. 2*a* in expanded configuration.
Figure 2C:
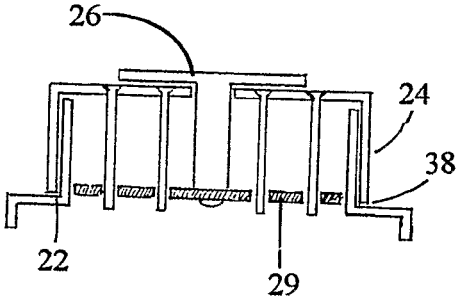
FIG. 2*c* is a cross section through the foodstuff holder of FIG. 2*a* in compacted configuration.
Figure 3A:
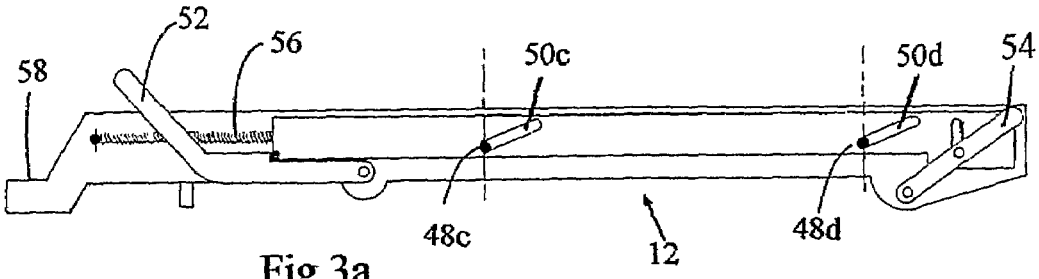
FIG. 3*a* is a cross section through the cutting base of a third embodiment of the base, with the horizontal cutting blade lowered.
Figure 3B:
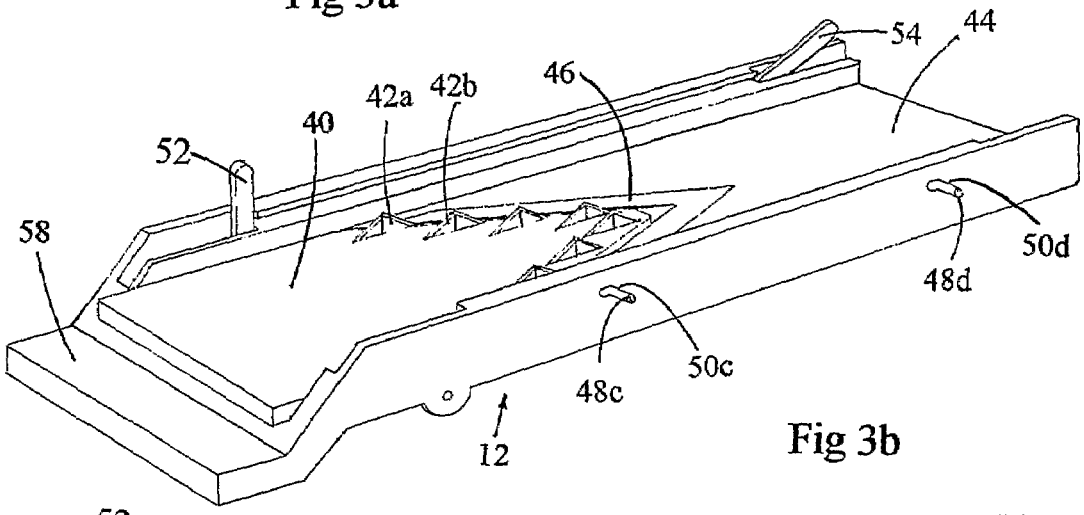
FIG. 3*b* is an isometric projection of the third embodiment, with horizontal cutting blade lowered.
Figure 3D:
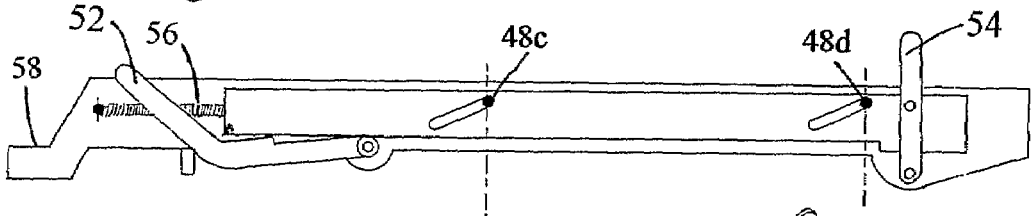
FIG. 3*d* is a cross section through the cutting base of FIG. 3*a*, with cutting blade in the raised position.
Figure 3C:
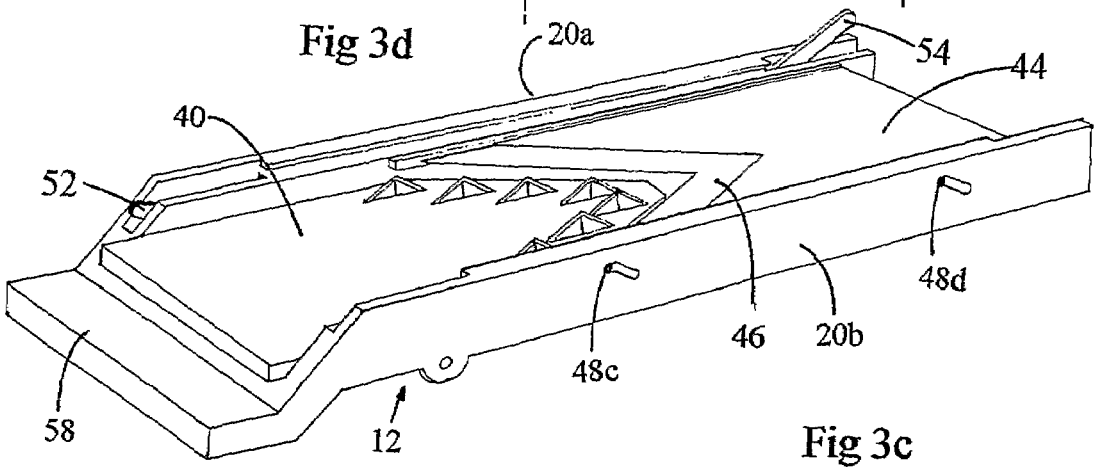
FIG. 3*c* is an isometric projection of the cutting base of FIG. 3*a*, with horizontal cutting blade raised.
Figure 3E:
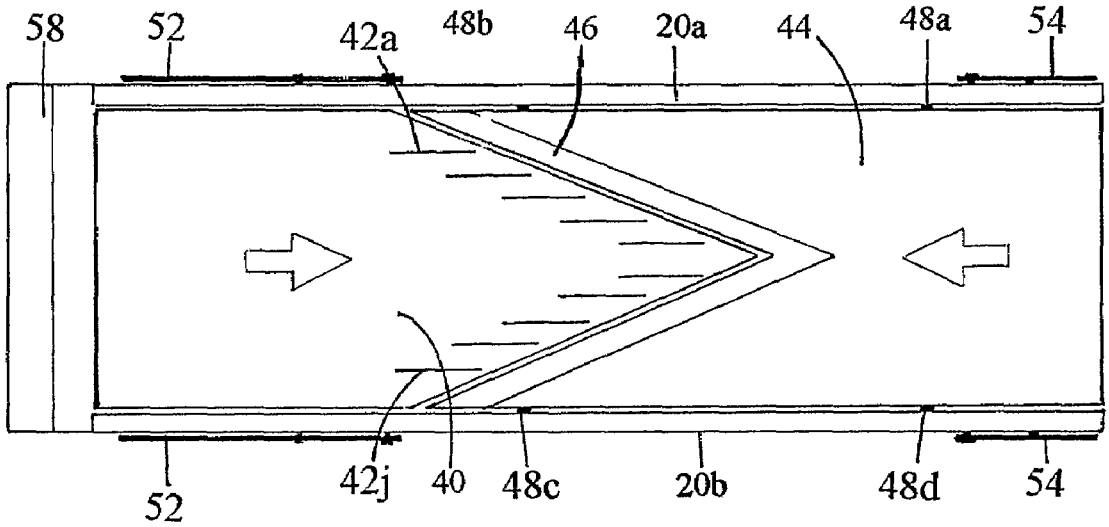
FIG. 3*e* is a plan view of the cutting base of FIG. 1.

With reference to FIGS. 2*a*-2*c*, according to one embodiment, the foodstuff holder 14 comprises a lower section 22, an upper section 24 and a pusher 26. The lower section 22 is an open cylinder, having a flange 16 around mouth 28 thereof, with two edges 18*a*, 18*b* that slidingly engage the walls 20*a*, 20*b* of the cutting base 12 (See FIG. 1). The upper section 24 has an inverted cup shape that fits over the lower section 22. A pin array 30*a*-*d* consisting of a plurality of pins 30*a*-30*d* protrudes downwards from the inside upper surface 32 of the upper section 24. An item of foodstuff (not shown), such as a tomato or a potato, for example, may be placed within the foodstuff holder 14, and partially impaled on the plurality of pins 30*a*-30*d*. The pusher 26 consists of a perforated plate 29 that slides along the plurality of pins 30*a*-30*d* and is situated over the foodstuff impaled thereupon, such that pushing on the pusher 26 forces stem 34 of pusher 26 downwards through hole 36 in upper section 34 and pushes perforated plate 29 downwards with respect to the pin array 30.

Rotation of the upper section 24 of the foodstuff holder 14 with respect to the lower section 22 thereof, rotates foodstuff impaled on pin array 30*a*-30*d* with respect to the lower section 22, which has a fixed orientation with respect to the cutting base 12 of the dicing tool 10, since edges 18*a*, 18*b* engage walls 20*a*, 20*b* of the cutting base 12, keeping the orientation of the lower section 22 constant with regards to the cutting base 12.

With particular reference to FIG. 2*b*, with perforated plate 29 raised with respect to the pin array 30 and upper section 24 raised with respect to the lower section 22, the foodstuff holder 14 can accommodate a potato, an apple or a large tomato, for example. With particular reference to FIG. 2*c*, pushing down on pusher 26 lowers perforated plate 29 and pushes foodstuff off the pin array 30 and lowers upper section 24 over lower section 22, until the lower rim 38 of upper section 24 contacts flange 16. Thus, by pushing on pusher 26, foodstuff may be forced out of the mouth 28 of the lower section 22, into cutting base 12 (FIG. 1).

With reference now to FIGS. 3*a*-3*e*, the cutting base 12 of FIG. 1 is shown. Cutting base 12 has two main parts: a first part 40 having a plurality of upstanding triangular knife blades 42 *a-j* protruding upwards therefrom, and a second part 44 having a cutting blade 46 attached thereto. The second part 44 is able to assume two configurations with respect to the first part 40. In a first configuration, shown in FIGS. 3*a* and 3*b*, the second part 44 having cutting blade 46 attached thereto is at the same level as the first part 40 that has a plurality of upstanding triangular knife blades 42 *a-j* protruding upwards therefrom. In the second configuration, shown in FIGS. 3*c* and 3*d*, the second part 44 having cutting blade 46 attached thereto is at a raised level with respect to the first part 40.

Figure 4:
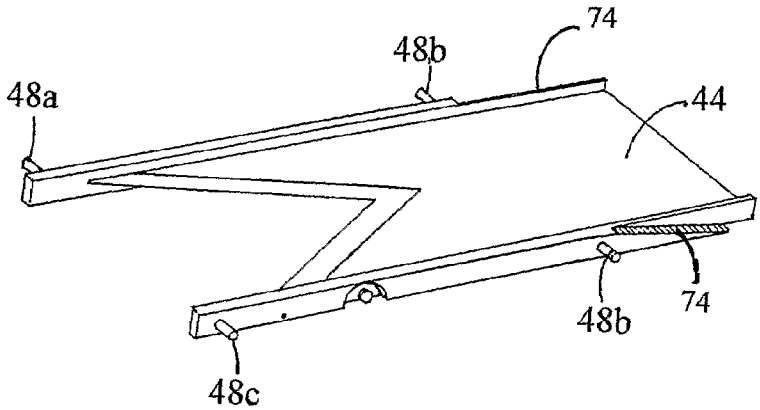
FIG. 4 is an isometric projection of the second part of the cutting base with the horizontal cutting blade attached, common to all above embodiments.

As shown in FIG. 4, the second part 44 of the cutting base 12 has a plurality of pegs 48*a*-48*d* protruding therefrom. Referring back to FIGS. 3*b* and 3*c*, Pegs 48*a*-48*d* engage diagonal slits 50*a*-50*d* in sides 20*a*, 20 of cutting base 12, and levers 52 and 54 can move the second part 44, back and forth, between upper and lower positions.

The foodstuff holder 14 is slid back and forth along the cutting base 12. At the end of each traverse, it pushes lever 52 or 54, thereby raising and lowering the second part 44 of the cutting base 12 with respect to the first part 40; the pegs 48*a*-48*d* sliding back and forth in the slits 50*a*-50*d*. A spring 56 may serve to urge the second part 44 with horizontal cutting blade attached 46, into one or other configuration.

To dice a foodstuff with the dicing tool 10, the second section 44 is brought into its lower position with respect to the first section 40, so that triangular vertical blades 42*a-j* protrude. The foodstuff in foodstuff holder 14 is slid across the cutting base 12 towards the handle 58. As foodstuff crosses triangular vertical blades 42*a-j*, a first series of equispaced vertical cuts is made in the bottom of the foodstuff. The foodstuff holder 14 knocks into lever 52 which raises the second part 44 into its upper position, raising V shaped cutting blade 46 to the height of the apices of the triangular vertical blades 42*a-j*. The foodstuff holder 14 is manually rotated through 90° by the operator, rotating the foodstuff impaled on pin array 30 therewithin. The foodstuff holder 14 is now slid back across the triangular vertical blades 42*a-j* which make a second series of equispaced vertical cuts in the bottom of the foodstuff that are perpendicular to the first series. The foodstuff is then drawn across the V shaped cutting blade 46, which slices through the foodstuff in a direction that is mutually perpendicular to the two sets of vertical cuts, severing cubes of food from the block of foodstuff.

By virtue of the deep V shape of the cutting blade 46, the dicing tool 10 is suitable for dicing even soft fruit and vegetables, such as tomatoes, for example. The dicing tool 10 may be used for a variety of foodstuffs, such as fruit, vegetables, cheese, tofu, soya curd, salami, minced meat or bread, for example.

Referring now to FIGS. 5*a* to 5*d*, in a second embodiment, the cutting base 10' has a clasp 60 attached to the second part 44', at the bottom thereof, behind the handle 58. Pulling on clasp 60 brings the second part 44' down into coalignment with the first part 40, bringing the V shaped horizontal cutting blade 48 behind the triangular shaped front edge of the first part 40, the second part 44' assuming its lower position thereby, extending and storing energy in the Hookian member, typically helical spring 56'. Releasing clasp 60 allows spring 56' to contract, bringing the second part 44' up away from the first part 40 and bringing the V shaped horizontal cutting blade 46 into alignment with the apices of the triangular vertical cutting blades, the second part 44' assuming its upper position thereby.

The embodiment of FIG. 5 may be used to dice food by the following method: (i) Bringing the second part 44' into its lower position by gripping the clasp 60 with the fingers of the hand holding the handle 58, squeezing clasp 60 to handle 58; (ii) Sliding the foodstuff holder along the cutting base 12 and over the upper surface of the first 40 and second 44' parts from the second part 44' onto the first part 40, across the triangular vertical blades 42*a-j* towards the handle 58, thereby making a first plurality of regularly spaced, equidistant vertical cuts in the block of foodstuff; (iii) releasing clasp 60, allowing spring 56' to contract, thereby causing the second part 44' to assume its upper position, aligning the V shaped horizontal blade 46 with the apices of the triangular vertical blades 42*a-j*; (iv) Rotating the foodstuff holder through 90°, thereby rotating the block of foodstuff with respect to the triangular vertical blades 42*a-j*, and (v) Drawing the block of foodstuff back over the cutting base 12, across the triangular vertical blades 42*a-j*, making a second plurality of regularly spaced, equidistant vertical cuts tangential to the first plurality of regularly spaced, equidistant vertical cuts, and across the V shaped horizontal blade 46, thereby slicing across the base of the block of foodstuff, severing cubes of foodstuff therefrom.

Figure 6:
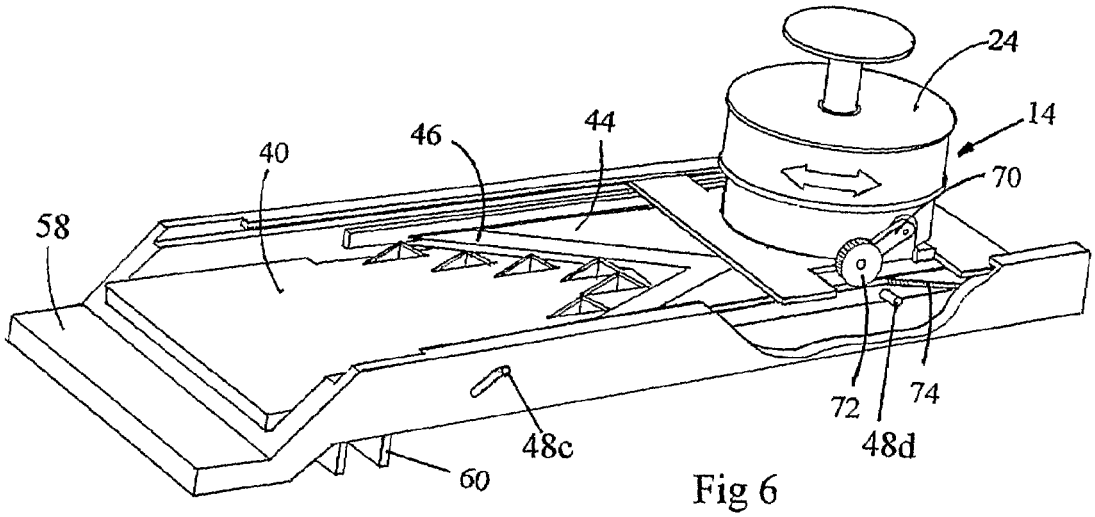
FIG. 6 is a cut-away isometric projection of yet a further embodiment, wherein rotation of the foodstuff holder raises and lowers second part of cutting base with respect to first part of cutting base.

With reference to FIG. 6, the flange 16 of a modified foodstuff holder 14 is cut away, and a wheel 72 mounted on a sprung lever 70 is provided so that pulling the lever causes the wheel 72 to press down on the second part 44", bringing it into alignment with the triangular shaped front edge of the first part 40, the second part 44" assuming its lower position thereby. Releasing the lever causes the wheel to retract 14 and the second part 44" which is also spring load by virtue of spring 56 is brought up away from the first part 40 and brings the V shaped horizontal cutting blade 46 into alignment with the apices of the triangular vertical cutting blades 43*a-j*, the second part 44" assuming its upper position thereby.

The third embodiment may be used for dicing a foodstuff by the method of: (i) pulling lever 70, thereby pressing second part 44" down with wheel 72, bringing the second part into its lower position; (ii) Sliding the foodstuff holder 14 along the cutting base 12" and over the upper surface of the first 40 and second 44 parts, from the second part 44 onto the first part 40, across the triangular vertical blades 42*a-j* towards the handle 58, making a first plurality of regularly spaced, equidistant vertical cuts in the block of foodstuff thereby; (iii) Releasing lever 70, causing wheel 72 to retract and bringing the second section 44" up away from the first section 40 thereby bringing the V shaped horizontal cutting blade 46 into alignment with the apices of the triangular vertical cutting blades 42*a-j*, the second section 44" assuming its upper position thereby, and (iv) Drawing the block of foodstuff back over the cutting base 12", across the triangular vertical blades 42*a-j*, making a second plurality of regularly spaced, equidistant vertical cuts tangential to the first plurality of regularly spaced, equidistant vertical cuts, and across the V shaped horizontal blade 46, thereby slicing across the base of the block of foodstuff, severing dices of foodstuff therefrom.

In a variant of the third embodiment, the second part 44" has a ramp attached along one edge thereof, and the lever 70 presses second part 44" down with wheel 72, bringing the second part into its lower position. At the end of the cutting operation, the wheel 72 comes off the ramp, and the second part 44" springs back to its upper position. Although in FIG. 6, only one wheel 72 and ramp 74 is shown, in preferred embodiments such a lever 70, wheel 72, ramp 74 is duplicated on both sides of the foodstuff holder 14.

In accordance with a further embodiment, the present invention is directed to providing a dicing tool comprising: a foodstuff holder for holding a block of foodstuff and a cutting base; the cutting base comprising: a rectangular framework with tracks along both sides thereof for sliding the foodstuff holder therealong; a first part having a slanted front edge and a first upper surface on which a plurality of equally spaced triangular cutting blades are fixed to protrude perpendicularly therefrom; the equally spaced triangular cutting blades being arranged in a slanted arrangement that follows the profile of the slanted front edge; a handle coupled rigidly to the first part, at short end thereof, opposite to the slanted edge; a second part having a slanted blade attached to the front edge thereof; such that the second surface is parallel to the first surface and can be slidingly reciprocated between an upper position where the horizontal blade is substantially on a level with the apices of the triangular cutting blades, and a lower position where the horizontal blade is substantially on a level with the first surface and the base of the triangular cutting blades.

Four mechanisms for conveniently moving the second part 44 up and down with respect to the first part are described. Other embodiments that are equivalents thereto will now suggest themselves to the reader.

It will be noted that unlike slicing tools of the prior art, the triangular vertical blades 42*a-j* are sharpened on both sides, and cut food stuff pushed thereover in both directions. Fabrication of such triangular blades is not easy.

Figure 7:
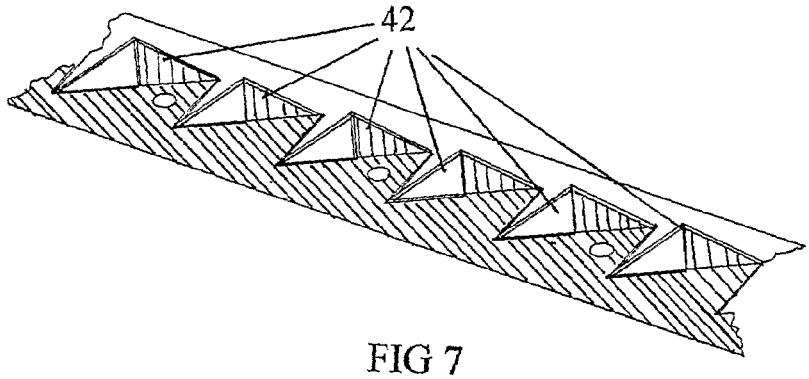
FIG. 7 shows a strip series of two edged triangular vertical teeth blades formed by spot welding two strips of single edged blades of the prior art.
Figure 5A:
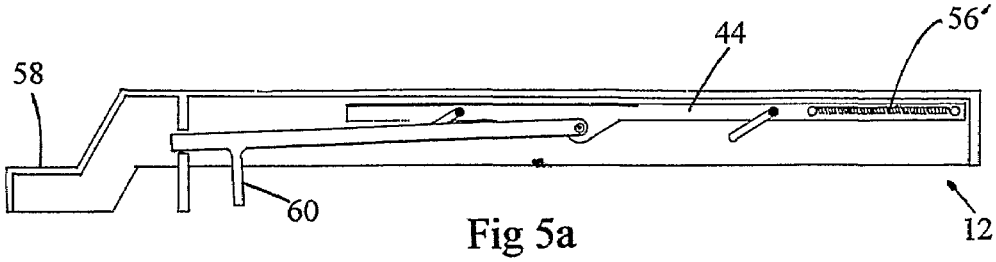
FIG. 5*a* is a side view of a cutting base according to a second embodiment with horizontal cutting blade raised.
Figure 5B:
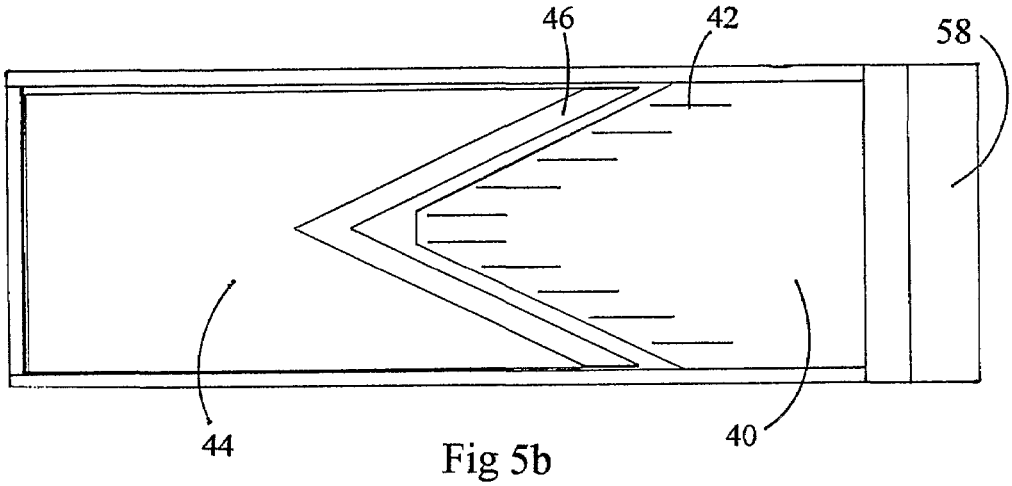
FIG. 5*b* is a plan view of a cutting base according to a second embodiment with horizontal cutting blade raised.
Figure 5C:
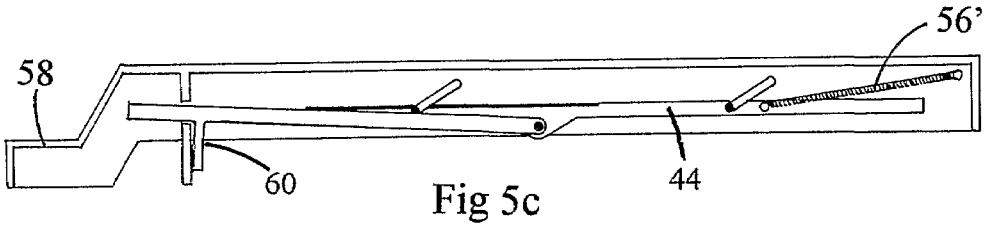
FIG. 5*c* is a side view of a cutting base according to a second embodiment with horizontal cutting blade lowered.
Figure 5D:
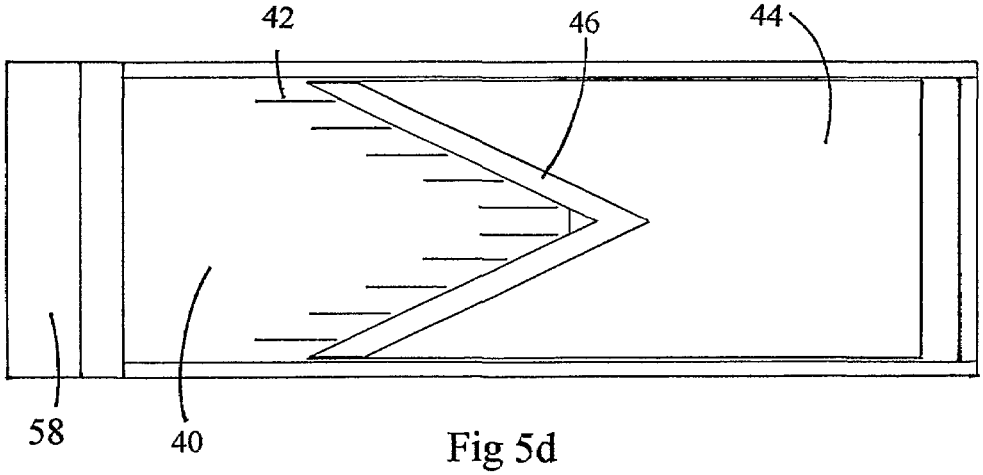
FIG. 5*d* is a plan view of a cutting base according to a second embodiment with horizontal cutting blade lowered.

As shown in FIG. 7, one effective way of fabricating triangular vertical blades 42*a-j* is to sharpen the whole lengths of two strips of steel, and to stamp out from one strip superfluous material, leaving front halves of teeth for folding into a strip such as that shown in U.S. Pat. No. 4,441,254 to Borner. The second strip has superfluous material cut out leaving back half teeth that may be folded into a second strip, and the two strips may be spot welded together thereby giving a single strip of triangular blades sharpened on both sides. The triangular vertical blades 42*a-j* may be poked through corresponding slots in the first part 40 of the horizontal cutting base 12, or the first part 40 may be injection moulded therearound.

Rotating the foodstuff holder through less than 90° allows lozenge shaped blocks to be cut. The V shaped and triangular blades could be corrugated, providing dice with fancy edges.

Other functionally equivalent embodiments will suggest themselves to the man of the art. These are within the scope of the invention, which is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A dicing tool comprising: a foodstuff holder for holding a block of foodstuff and a cutting base;

the cutting base comprising:

a rectangular framework for sliding the foodstuff holder therealong;

a first part having a V-shaped front edge and a first upper surface on which a plurality of equally spaced vertical triangular cutting blades are fixed to protrude perpendicularly therefrom, the equally spaced triangular cutting blades being arranged in a V-shaped arrangement that follows the profile of the V-shaped shaped front edge;

a handle coupled rigidly to the first part, at short end thereof, opposite to the triangular edge;

a second part having a second upper surface and a right front edge and a left front edge arranged in a deep V shape, with continuous horizontal blades attached to the right and left front edges;

such that the second upper surface is always parallel to the first surface and can be slidingly reciprocated between an upper position where the horizontal blade are substantially on a level with the apices of the triangular vertical cutting blades, and a lower position where the horizontal blade is substantially on a level with the first surface and the base of the triangular cutting blades;

the second upper surface having a pair of levers attached to opposite ends thereof;

such that the foodstuff holder in one direction trips a first lever and brings the second part down towards the first part, bringing the V shaped horizontal cutting blades into alignment with the V-shaped front edge of the first part, the second part assuming its lower position thereby;

whereas sliding the foodstuff holder in an opposite direction trips a second lever and brings the second part up away from the first part and brings the V shaped horizontal cutting blades into alignment with the apices of the triangular vertical cutting blades, the second part assuming its upper position thereby.

2. A method of dicing a foodstuff with the dicing tool of claim 1 comprising the steps of:

(i) bringing the second part into its lower position by impacting the first lever with the foodstuff holder;

(ii) sliding the foodstuff holder along the cutting base and over the upper surface of the first and second parts from the second part onto the first part, across the triangular vertical blades towards the handle thereby making a first plurality of regularly spaced, equidistant vertical cuts in the block of foodstuff;

(iii) impacting the second lever with the foodstuff holder thereby causing the second part to assume its upper position, thereby aligning the V shaped horizontal blades with the apices of the triangular vertical blades;

(iv) rotating the foodstuff holder through 90°, thereby rotating the block of foodstuff with respect to the triangular vertical blades, and (v) drawing the block of foodstuff back over the cutting base, across the triangular vertical blades making a second plurality of regularly spaced, equidistant vertical cuts perpendicular to the first plurality of regularly spaced, equidistant vertical cuts, and across the V shaped horizontal blades, thereby slicing across the base of the block of foodstuff, severing dices of foodstuff therefrom.

* * * * *